US005987897A

United States Patent [19]

Hall

[11] Patent Number: 5,987,897

[45] **Date of Patent: *Nov. 23, 1999**

[54] ICE BANK SYSTEM

[75] Inventor: James R. Hall, Hillard, Ohio

[73] Assignee: Ranco Incorporated of Delaware, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 09/086,334

[22] Filed: May 28, 1998

Related U.S. Application Data

[60] Provisional application No. 60/048,138, May 30, 1997, and provisional application No. 60/048,942, Jun. 16, 1997.

[51] Int. Cl.[6] ..... F25C 3/00

[52] U.S. Cl. ..... 62/59; 62/139; 62/201

[58] Field of Search ..... 62/59, 139, 138, 62/201

[56] References Cited

U.S. PATENT DOCUMENTS

| | | | |
|---|---|---|---|
| 2,459,337 | 1/1949 | Raney . | |
| 2,632,308 | 3/1953 | Engelhardt | 62/59 |
| 3,496,733 | 2/1970 | Parker et al. | 62/139 |
| 3,502,899 | 3/1970 | Jones | 62/139 |
| 3,898,856 | 8/1975 | Komedera | 62/98 |
| 4,008,832 | 2/1977 | Rodth | 62/138 |
| 4,011,733 | 3/1977 | Kuckens et al. | 62/59 |
| 4,365,486 | 12/1982 | Iwanami et al. | 62/392 |
| 4,497,179 | 2/1985 | Iwans | 62/59 |
| 4,526,012 | 7/1985 | Chigira | 62/201 |
| 4,561,263 | 12/1985 | Bonne | 62/176.2 |
| 4,823,556 | 4/1989 | Chesnut | 62/139 |
| 4,843,830 | 7/1989 | Haul | 62/59 |
| 4,934,150 | 6/1990 | Fessler | 62/59 |
| 5,022,233 | 6/1991 | Kirschner et al. | 62/138 |
| 5,163,298 | 11/1992 | Hassell et al. | 62/59 |
| 5,399,300 | 3/1995 | Notar | 261/130 |
| 5,502,977 | 4/1996 | Ziesel et al. | 62/139 |

FOREIGN PATENT DOCUMENTS

| | | |
|---|---|---|
| 0315439 A2 | 2/1988 | European Pat. Off. . |
| 2133130 | 7/1984 | United Kingdom . |

*Primary Examiner*—William E. Tapolcai

*Attorney, Agent, or Firm*—Watts, Hoffmann, Fisher & Heinke Co., LPA

[57] ABSTRACT

A refrigeration system control apparatus for use with an ice bank for sequentially cycling a refrigerator compressor on and off based on sensed conditions. The system includes a first temperature probe located a first distance from a refrigerator evaporator coil and a second temperature probe located a second, greater distance from the refrigerator evaporator coil. A programmable controller monitors temperature outputs from the first and second temperature probes and turns on and off the refrigerator compressor based upon a rate of change of the temperature difference between the sensed temperatures of the first and second probes.

13 Claims, 6 Drawing Sheets

ICE BANK SYSTEM

RELATED APPLICATION

The present application claims benefit of U.S. provisional applications Ser. No. 60/048,138, filed May 30, 1997, and Ser. No. 60/048,942, filed Jun. 16, 1997, both entitled Ice Bank System.

FIELD OF THE INVENTION

The present invention concerns an ice bank control system to avoid freezing of liquids such as soft drinks that are cooled by the ice bank.

BACKGROUND ART

Representative prior art patents relating to Ice Banks are U.S. Pat. Nos. 5,163,298, 4,934,150, 4,843,830, 4,823,556, 5,502,977,5,399,300, 4,497,179, 2,459,337, 5,022,233, and published EPO patent application No. 0315 439.

An ice bank for a beverage dispenser includes a complete refrigeration system that includes a compressor, condenser and evaporator all interconnected by fluid delivery conduits for delivering refrigerant through the system.

In representative prior art ice banks for dispensing beverages, the ice bank includes multiple different beverage dispensers arranged in a line that allow a customer or restaurant employee to choose an appropriate dispenser and fill a cup with the chosen cool beverage such as a softdrink. An ice bank housing surrounds an evaporator coil arrangement which in turn surrounds dispensing lines for the soft drink syrup. Both the soft drink dispensing lines and the evaporators are immersed in a water bath to enhance heat transfer from the water bath to the evaporator to cool the bath and thereby cool the soft drink dispensing line.

SUMMARY OF THE INVENTION

The present invention concerns a refrigeration system utilizing control method and apparatus for use with an ice bank for sequentially cycling a refrigerator compressor on and off based on sensed conditions. The system includes a first temperature probe located a first distance from a refrigerator evaporator coil and a second temperature probe located a second, greater distance from the refrigerator evaporator coil. A programmable controller monitors temperature outputs from the first and second temperature probes and turns on and off the refrigerator compressor based upon a change of the temperature difference between the sensed temperatures of the first and second probes.

A beverage dispensing ice bank includes a complete refrigeration system. The evaporator coil is immersed within a water bath that cools beverages passing through delivery conduits that also pass through the water bath. The two temperature sensing probes are mounted in close proximity to the evaporator coil and detect ice build up on the evaporator coils. This information is used to control the turning on and off of the compressor. One object of the disclosed process is to allow efficient heat transfer between the evaporator coils and the water bath without allowing ice to build up on drink delivery coils leading to the drink dispenser. Allowing too much ice to build up on the evaporator coils can result in the ice contacting the drink delivery coils and the liquid in those coils to freeze. Such freezing can cause the drink delivery coil to burst requiring costly repair to the ice bank. By monitoring the ice as it build up on the evaporator coil the present invention provides efficient ice bank operation without damaging the ice bank.

These and other objects, advantages and features of the invention will be better understood from a review of the description of a preferred embodiment of the invention which is described in conjunction with the accompanying drawings.

BEST MODE FOR PRACTICING THE INVENTION

Figure 1:
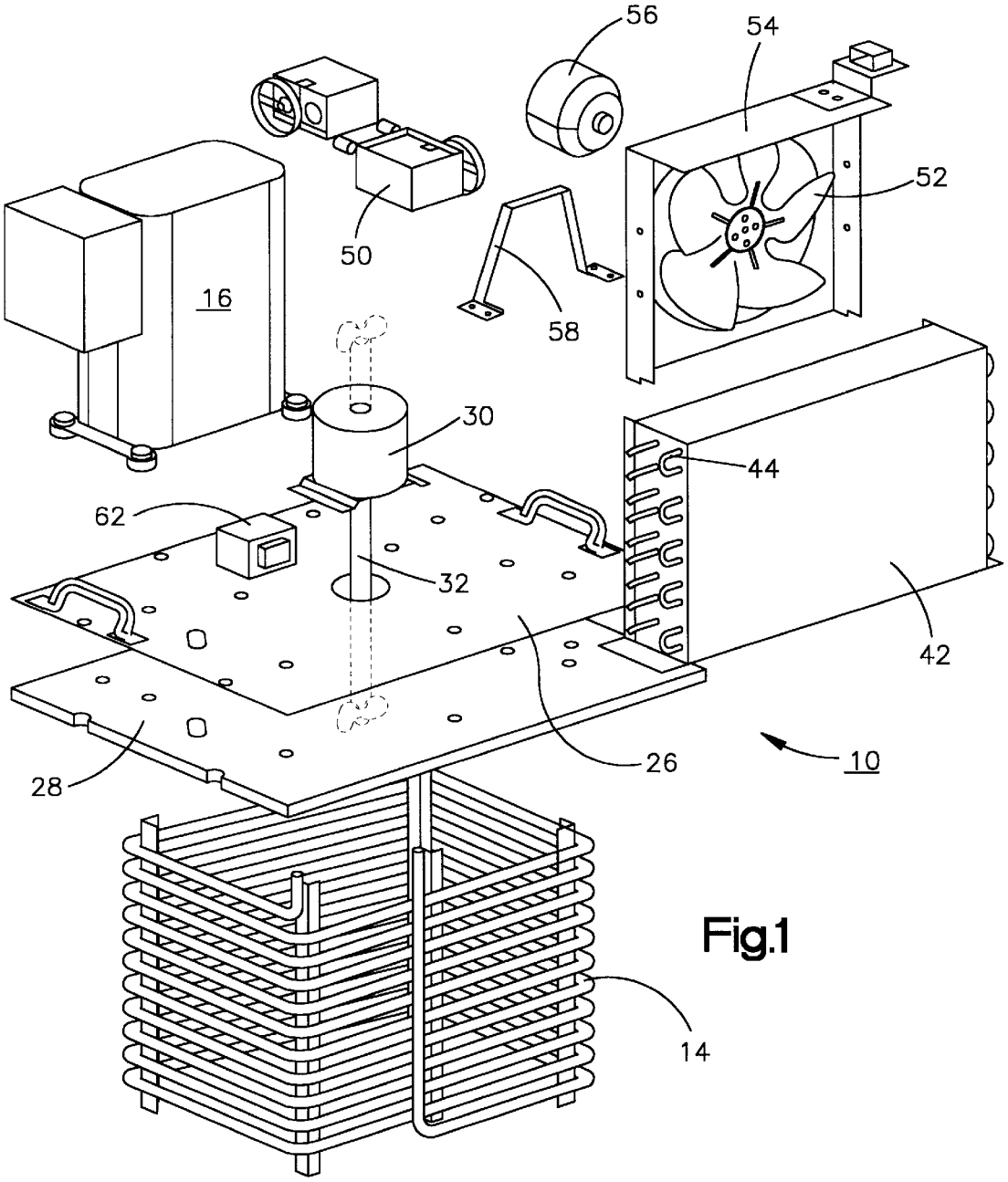
FIG. 1 is an exploded perspective view of components of an ice machine.
Figure 2:
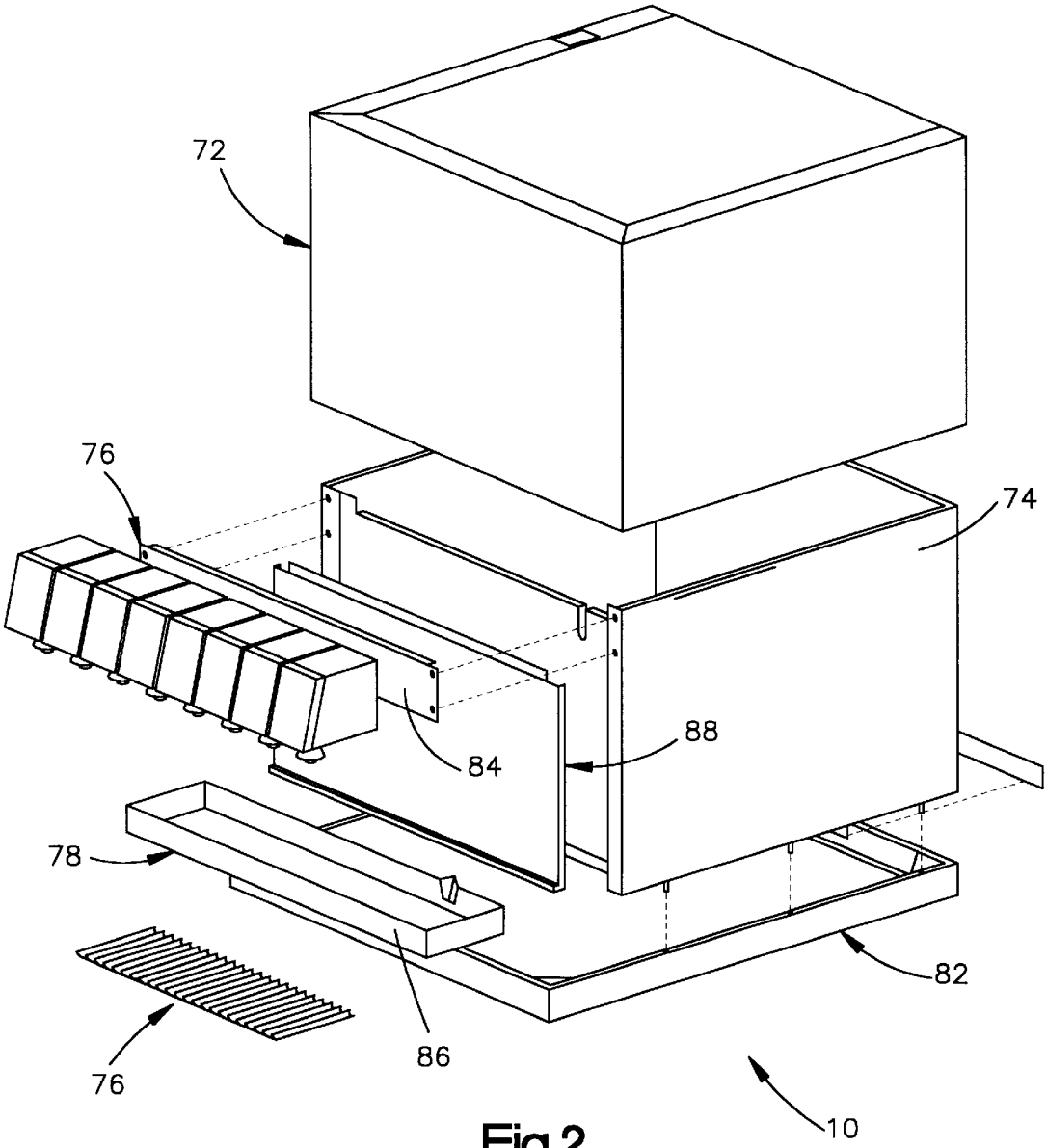
FIG. 2 is an exploded perspective view of an exterior of an ice machine.

FIGS. 1 and 2 depict an ice bank 10 that includes a control circuit 12 (FIG. 8) for controlling the formation of ice on evaporator coils 14 of the ice bank. The evaporator coils 14 form part of a refrigeration system that includes a compressor 16 for routing hot, compressed refrigerant into and through a closed loop refrigeration system. As the compressed liquid refrigerant enters and passes through the evaporator coils 14, it expands and enters a gaseous state as it is heated by its environment. As the refrigerant gathers heat, the region near the coils is cooled.

Figure 3:
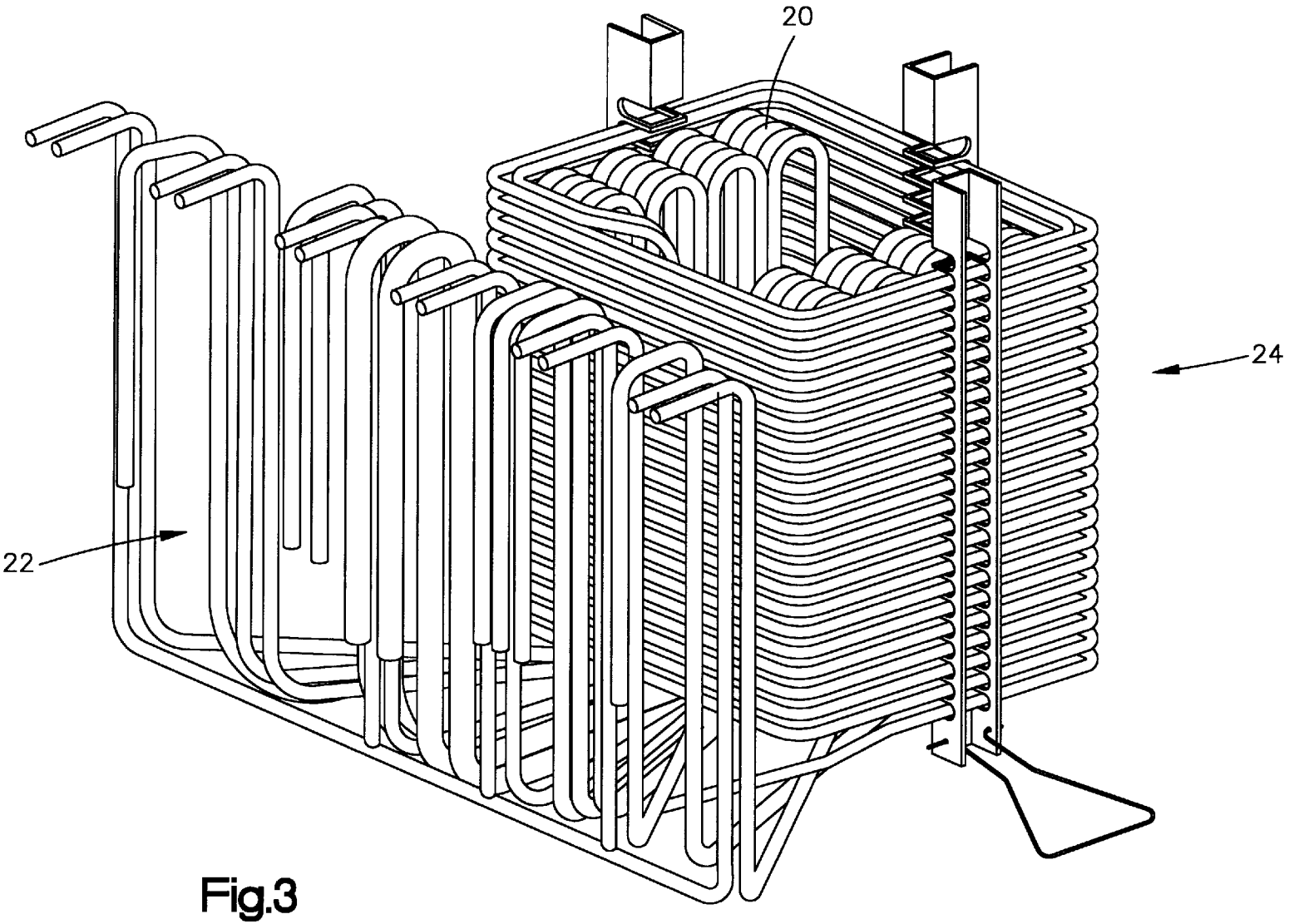
FIG. 3 is a perspective view of a number of syrup coils for dispensing soft drink syrup from the ice machine.

The evaporator coils 14 surround an array of coils 20 (FIG. 3) that deliver carbonated water and soft drink syrup through the coils on their way to liquid dispensing region 22 positioned at the front of the ice bank 10. A softdrink is dispensed by a user standing in front of the ice bank 10 and actuating a chosen one of multiple dispensers to cause a soft drink to be dispensed from the ice bank into a cup placed in front of the dispenser. Both the carbonated water and syrup coils 20 and the evaporator coils 14 are immersed in a water bath.

As the water bath is cooled ice forms on the outside of the evaporator coils 14. At periodic intervals the compressor is deactivated to avoid so much ice build up that the ice extends inwardly to contact the carbonated water and syrup coils 20.

Referring to FIG. 1, one sees the various components that make up the ice bank 10 and the refrigeration system for cooling a water bath within a region 24 of the water bath. The components depicted in FIG. 1 (except the evaporator coils 14) are mounted above the water bath and are supported by a base plate 26 that is spaced from the water in the water bath by an insulator 28.

An agitator motor assembly 30 is mounted to the base plate 26 so that an output shaft 32 from the motor assembly 30 extends into the water bath and rotates a agitator 34 which mixes the bath to promote uniform temperatures in the water bath. The refrigeration compressor 16 and condenser 42 having heat exchange coils 44 are interconnected by conduits that include the array of evaporator coils 14 which are supported beneath the base plate 26 within the ice bank water bath. An ice bank control unit 50 houses the control circuit 12 for turning on and off the compressor based on sensed temperatures in close proximity to the evaporator coils. The ice bank 10 supports a fan 52 within a fan shroud 54 and powered by a fan motor 56 mounted by a bracket 58. The fan 52 blows air across the condenser coils 44 to promote heat transfer between refrigerant in the condenser coils and the air passing the coils 44. An expansion valve on a downstream side of the compressor accepts hot compressed refrigerant and allows the refrigerant to expand as it passes into the evaporator coils.

Figure 8:
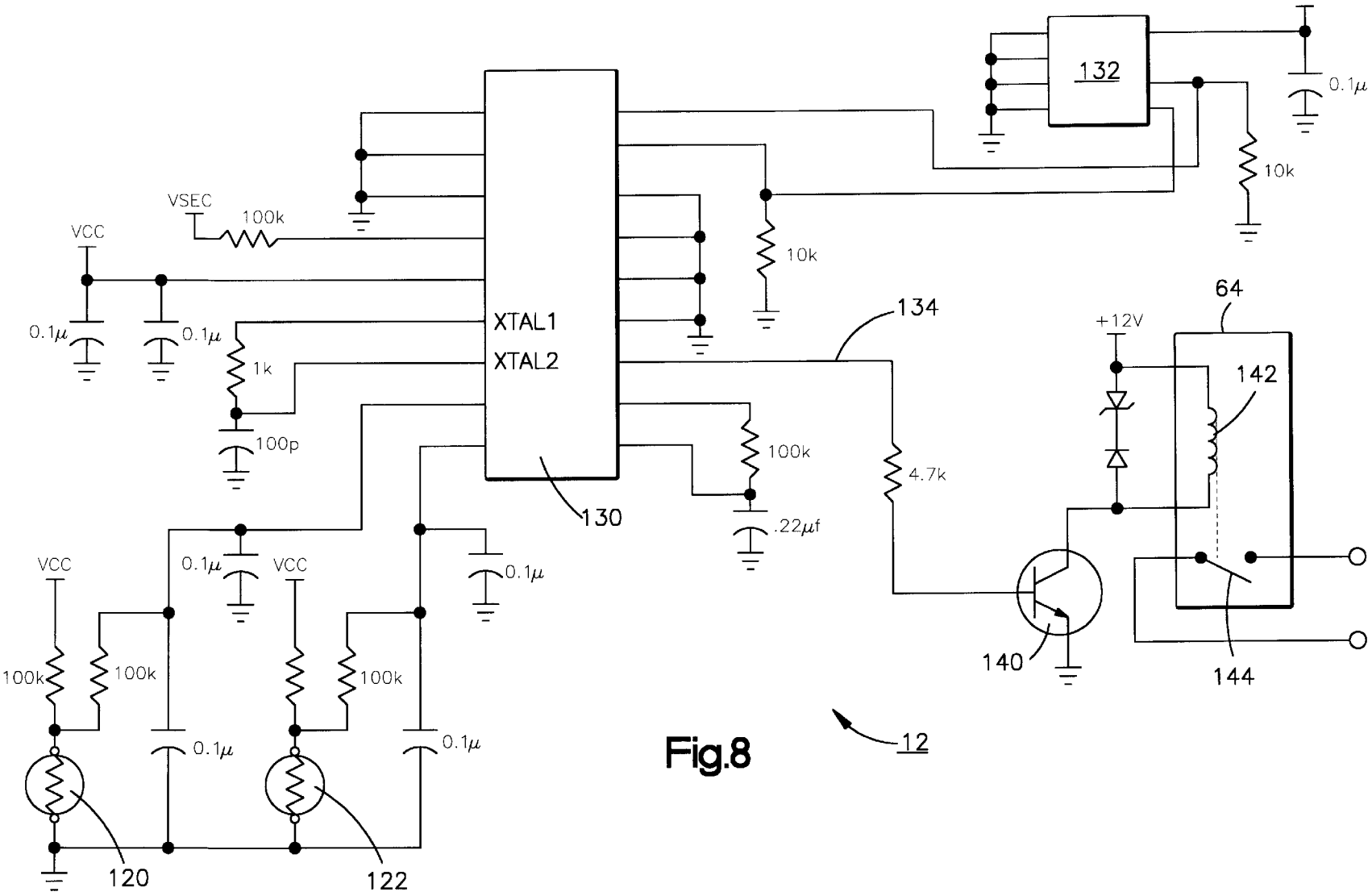
FIG. 8 is a schematic of a circuit for monitoring sensed conditions and controlling a relay coil for turning off and on a compressor motor.

The disclosed ice bank operates on AC power delivered as 120 volt alternating current. An AC input to the ice bank is stepped down in voltage by a transformer 62 supported by the base plate and then rectified by a power supply circuit (not shown). The power supply circuit applies low voltage DC signals on the order of five volts to power the controller 12 and also provides twelve volt DC signals for activating a compressor motor relay 64 (FIG. 8).

An ice bank cabinet (FIG. 2) includes a top assembly 72 that encloses the refrigeration components depicted in FIG. 1. The top assembly 72 is positioned above a water bath assembly 74 that encloses the evaporator coils 14 and syrup coils 20. A front side of the ice bank 10 supports an array of dispenser control valves 76 that mix carbonated water passing through delivery coils 20 and syrup in separate coils (in the case of soft drinks), dispense a beverage that has been cooled by passage through the coils 20 and mixed by mixing valves, and dispensed into cups (not shown) resting on a support 76 located above a drip pan 78. The exploded perspective view of FIG. 2 also includes a base 82, valve mounting plate 84 drip pan skirt 86 and splash plate 88.

Figure 5:
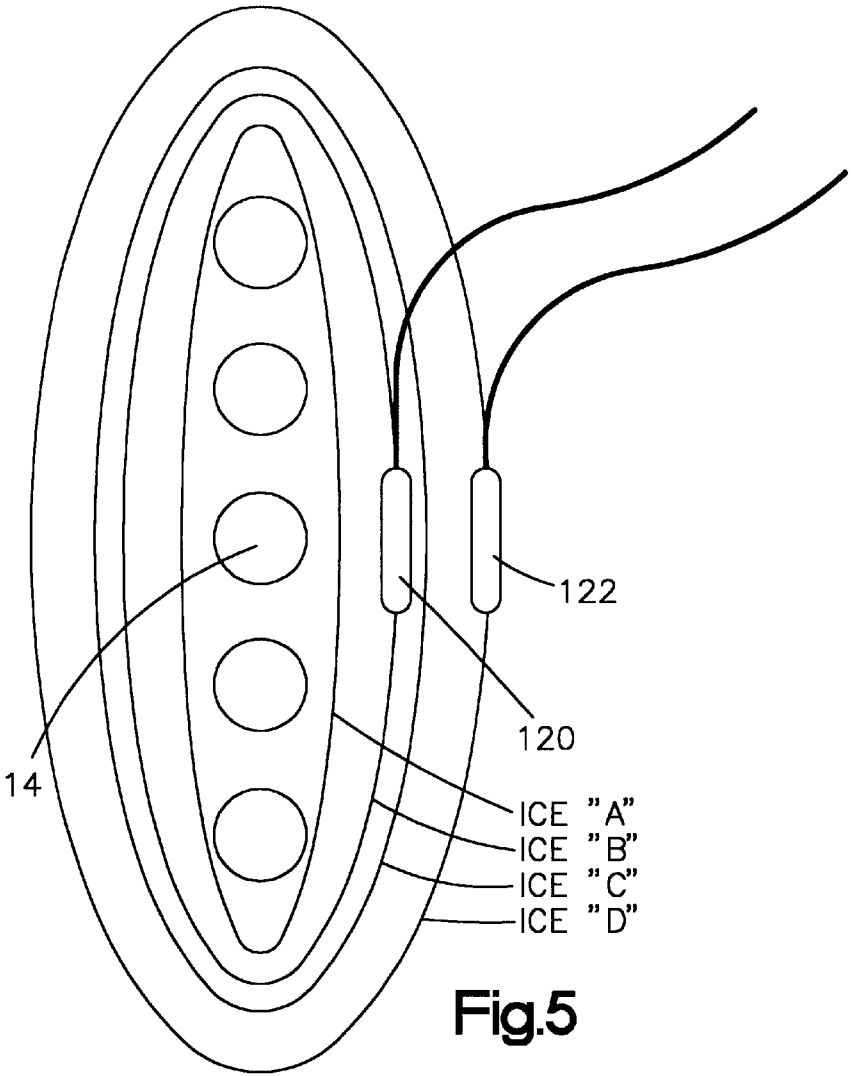
FIG. 5 is an enlarged depiction showing the space of the temperature sensing probes in relation to the evaporator coils.
Figure 4:
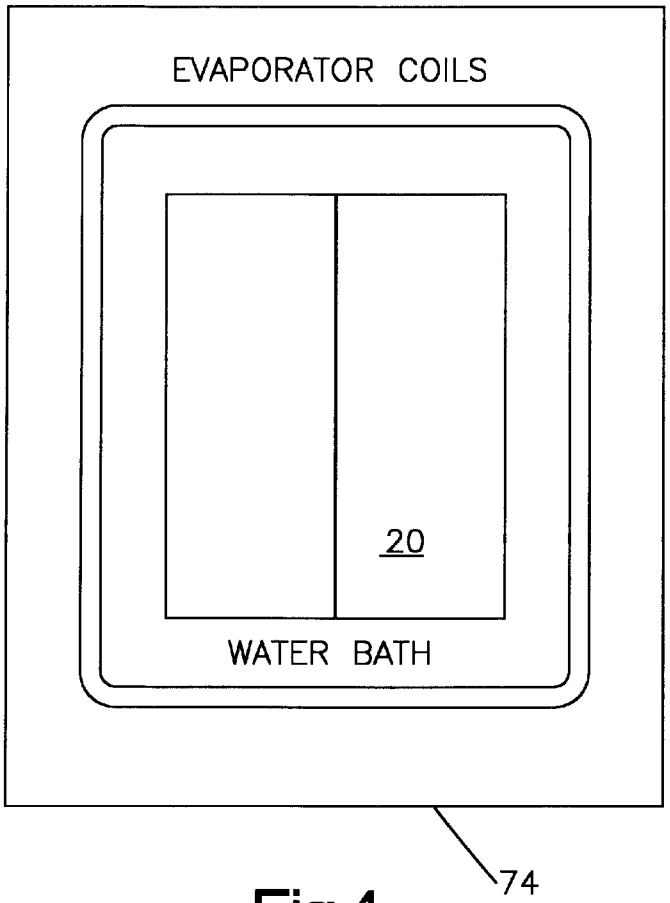
FIG. 4 is a top view showing a spacing between syrup coils and the evaporator coils that surround the syrup coils.

FIG. 5 depicts a relative position of two temperature sensing probes 120, 122 in relation to refrigeration evaporator coils 14 for extracting heat from the water bath to cool the bath. The temperature probes 120, 122 extend from above through the insulator 28 into the water bath in a region between the evaporator coils 14 and the syrup coils 20. The probes generate analog signals that are utilized by a programmable controller 130 for use in limiting ice formation on the evaporator coils 14. If so much ice is generated that the Ice contacts the syrup coils 20 located within the confines of the coils 14 (FIG. 3) may burst.

The Ice Bank control circuit 12 includes a programmable controller 130 (FIG. 8) which is most preferably a microprocessor controller having an appropriate interface for converting the analog output from the probes 120, 122 to digital values for calculation by the microprocessor. The controller controls the degree of ice formation on the evaporator coils of an ice bank within the beverage dispenser. Most preferably these two probes 120, 122 are temperature sensitive thermistors that exhibit well defined temperature characteristics as the compressor runs to sense the thickness of ice during operation of the ice bank. The technique that the controller implements involves taking the readings from the probes 120, 122 and incorporating them into an algorithm that will control the unit's efficiency better than prior art electromechanical devices.

A schematic of an exemplary control circuit 12 is depicted in FIG. 8. The programmable controller 130 (part no. Zilog Z86C08) includes a two kilobyte ROM memory for storing important operating data that is loaded from an EPROM circuit 132 that stores this data every time power is removed from the control circuit 12. Regardless of the power disruption interval , upon reapplication of power these values are read from the EPROM into the controller 130. An output 134 from the controller 130 is coupled to a switching transistor 140 to turn the transistor on and thereby activate a relay coil 142 that closes a compressor contact 144. When the contact 144 closes a compressor motor is energized and when the contact 144 opens the compressor is deactivated.

Figure 7:
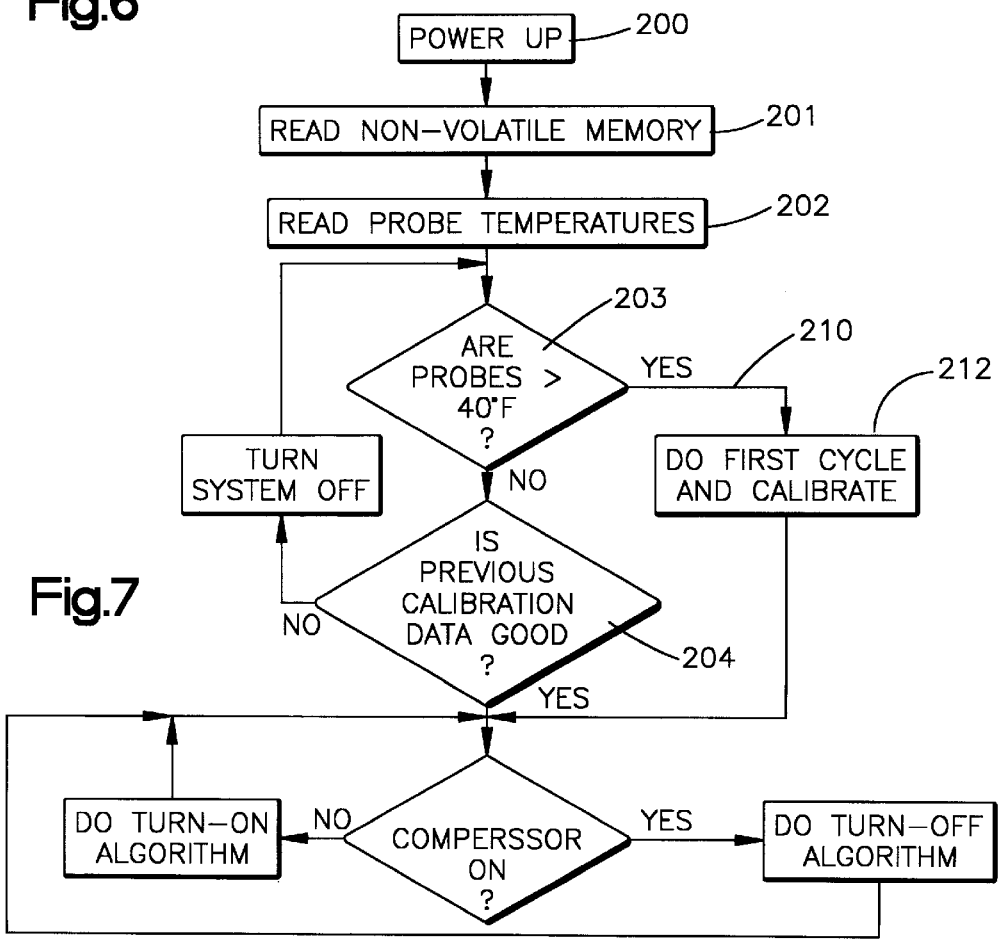
FIG. 7 is a control algorithm for controlling a defrosting of the evaporator coil to avoid formation of ice on the syrup delivery tubes supported within the evaporator coils.

FIG. 7 is a flow chart of a control program operating system performed by the programmable controller. When power is applied to the programmable controller 130, initialization steps 200–202 are performed and the controller checks 203 to see if both of the probes 120,122 sense a temperature of less than 40 degrees F. If both of the probes are at less than 40 degrees F the controller checks 204 the calibration data and if the calibration is in error the system activates a warning.

In the disclosed design, a first temperature probe 120 is located a short distance away from an evaporator coil 14 and a second temperature probe 122 is located at a distance of approximately one half inch from the first probe 120. After a layer of ice builds up around the evaporator coil 14 the controller 12 turns off the compressor at controlled intervals so that the layer of ice never shrinks below the inner probe and never exceeds the outer probe.

First Cycle

During the first cycle of operation, the water's freezing point and the differential shut off temperature are determined. If, after power is applied, both probes are above 40 degrees F and the probes are mounted and are functional, the controller branches 210 to perform its first operational cycle 212.

The controller begins by doing calibration, i.e. measures the probe temperature for one minute prior to energizing the compressor. Before the compressor is energized, ice should not exist during the first cycle 212. Also, the probes should be at approximately the same temperature. The probe temperatures are sensed and saved for calibration and then the compressor is turned on.

The freezing point of the water varies depending on the type of water and whether the water contains other contaminants such as soft drink syrup. The controller defines the freezing temperature to be the temperature sensed by the probe 122 that is located furthest from the coil 14 after ice forms on the inner probe.

Figure 6:
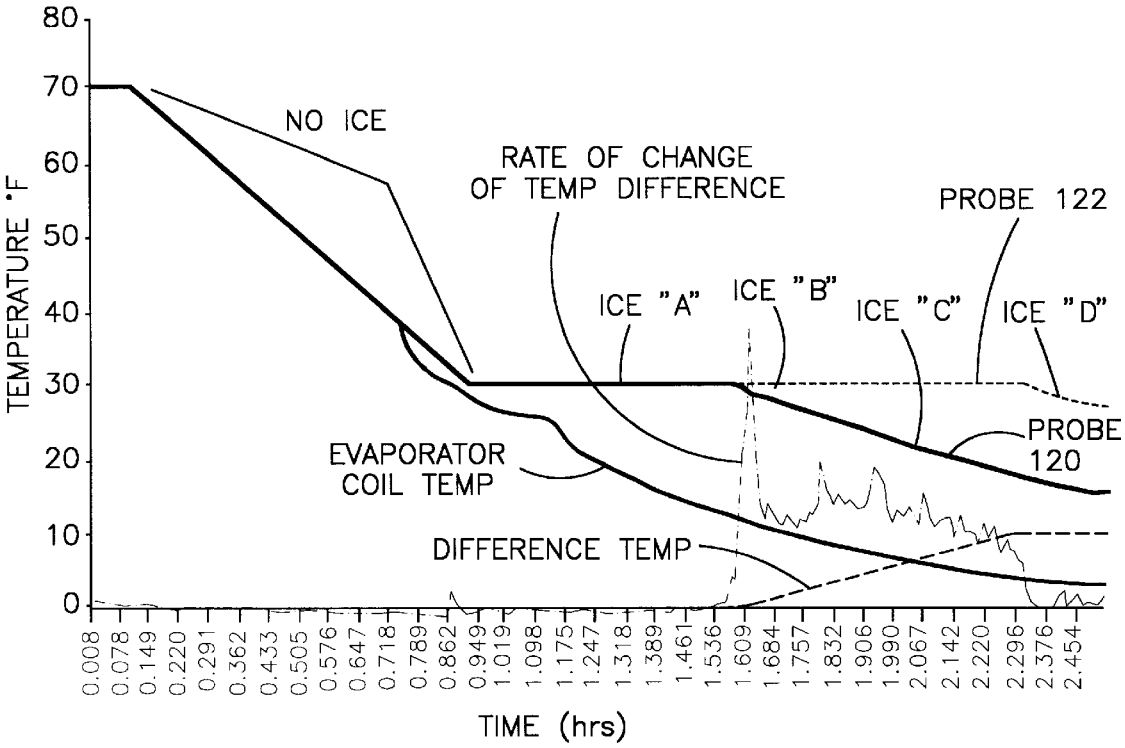
FIG. 6 is a graph showing temperature as a function of as sensed on the evaporator coil and as measured on two temperature sensor coils spaced from the evaporator coil.

During the first cycle, the controller will turn off the compressor only when the rate of change of the differential temperature between the temperature probes dips to zero after peaking when the two probe temperatures split apart due to the presence of ice on the inner probe but not the outer probe. FIG. 6 illustrates sensed temperature of the probes as well as the evaporator coil as a function of time. When the compressor starts running both probes have essentially the same temperature. When ice begins to form on the expansion coil the two probe temperatures stabilize while the temperature of the expansion coil continues to drop. Once ice forms on the probe closest to the evaporator coil, a temperature difference exists between the two probes 120, 122. As seen in FIG. 6 when the temperature on the probes varies there is a rapid rate of change of the difference that gradually decreases in size. As ice begins to form on the outer probe 122, the temperature on this probe begins to drop and the temperature difference between the two probes remains constant. The rate of change of this difference diminishes to zero and at that point the compressor is turned off.

On Cycle

There are two ways for the controller to determine when the compressor should be turned back on. These two ways are based on either timing or temperature. When a thermal load is encountered (drinks are being poured) the outer most probe detects a rise in temperature and based on this rise the controller turns on the compressor. The rise needed to activate the compressor is adjusted from 1 to about 1.5 degrees.

If no thermal load is sensed to produce the increase in temperature of the outer probe, then the controller turns back on the compressor based on a timing routine. This timing routing is based on how long the unit was on as well as how long it was off during the controller's last compressor's previous on/off cycle. A representative relation is:

Toff (new)=Toff(previous)−K*(Ton (desired)−Ton (previous)) where K is an empiracle constant.

Regardless of the sensed time or temperature criteria, the controller will not turn back on the compressor for a lock-out period of five minutes. Turn on due to temperature is based on the freezing point of water that was determined during the first compressor run cycle. If either of the probes 120, 122 senses a threshold rise of 1–1.5 or more degrees Fahrenheit above this freezing point, the controller will turn back on the compressor after the five minute lockout period.

The controller monitors time durations of compressor run time. If the compressor was on for a long period of time on a previous cycle, (absent a temperature rise) the unit will turn the compressor off for a short duration, since it was likely the controller is faced with a thermal load. If the compressor was on for a short interval during a previous cycle, the controller will keep the compressor off for a relatively longer period of time since there was presumably no thermal load and absent a temperature increase there is presumably still no such load.

Subsequent Cycle Turn Offs

On every one cycle except the first, the controller will monitor differential temperature from when the unit turned off during the first cycle (max $\Delta T$)and use that as a gauge of when to turn off the compressor. The turn off temperature criteria is typically 60 to 70% of the first cycle turn off differential.

Turning to FIG. 6 one sees that when the compressor is running, if no ice has developed on the inner probe, then both probes are at a temperature of greater than 32 degrees F. the temperature differential is approximately 0 degrees and the rate of change of the temperature difference is 0 degrees/time. When ice has formed between the two probes but not reached the probe furthest removed from the evaporator coil the temperature on the inner probe is less than 32 degrees F. and on the outer probe is greater than or equal to 32 degrees F. The temperature differential is greater than 0 and reaches a maximum of about 11–15 degrees F when ice just reaches the second or outermost probe. The rate of change of the differential is greater than zero. When both probes are covered with ice, both probes are less than 32 degrees F., the differential is greater than zero, (11–15 degrees is typical) and the rate of change of the differential approaches zero.

After the first cycle, if the compressor is not running certain observations can be made. Under a heavy load condition, noticeable increase in water temperature is noted. Under light load, the water bath surrounding the syrup coils maintains its melting point temperature even though the ice surrounding the evaporator coils is melting. Finally the probe closest to the evaporator coil comes up to with 1 degree F. of the water bath temperature within 10 minutes of the compressor shutoff.

While the present invention has been described with a degree of particularity, it is the intent that the invention include all modifications and alterations falling within the spirit or scope of the appended claims.

I claim:

1. In a refrigeration system control apparatus for sequentially cycling a refrigerator compressor on and off based on sensed conditions comprising:

a) a first temperature probe located a first distance from a refrigerator heat exchanger;

b) a second temperature probe located a second, greater distance from the refrigerator heat exchanger than the first temperature probe; and c) a controller for monitoring temperature outputs from the first and second temperature probes and turning on and off the refrigerator compressor based upon a sensed temperature difference between the first and second probes.

2. The control system of claim 1 wherein the controller turns on and off the refrigerator compressor based upon a sensed rate of change of a temperature difference.

3. The control system of claim 1 additionally comprising an ice bank wherein the refrigerator heat exchanger cools a water bath containing a conduit for routing a beverage to a dispensing spout and wherein the first temperature probe is mounted a first distance from coils of the heat exchanger and the second temperature probe is mounted a second greater distance from the heat exchanger and wherein the controller turns off the compressor when ice build up is sensed on the second temperature probe.

4. The control system of claim 3 wherein the first and second temperature probes are located in a region between the coils of the heat exchanger and the delivery conduit for routing the beverage through the ice bath.

5. The control system of claim 1 wherein the controller additionally turns on and off the refrigerator compressor based on sensed temperature of one or both of the temperature probes.

6. The control system of claim 1 wherein the controller additionally turns on and off the refrigerator compressor based on timed intervals following operation of the refrigerator compressor.

7. In a refrigeration system control, a method for sequentially cycling a refrigerator compressor on and off based on sensed conditions comprising the steps of:

a) positioning a first temperature probe located a first distance from a refrigerator heat exchanger;

b) positioning a second temperature probe located a second, greater distance from the refrigerator heat exchanger than the first temperature probe; and c) monitoring temperature outputs from the first and second temperature probes and turning on and off the refrigerator compressor based a sensed temperature difference between the sensed temperatures of the first and second probes.

8. The control system method of claim 7 wherein the refrigerator heat exchanger cools a water bath in an ice bank for cooling a beverage and the controlled turning on and off of the refrigeration compressor is performed to avoid ice build up on a beverage delivery conduit in the water bath.

9. The control system method of claim 7 additionally comprising the steps of turning on and off the refrigerator compressor based on sensed temperature of one or both of the temperature probes.

10. The control system method of claim 7 wherein the step of turning on and off the refrigerator compressor is based on a rate of change of sensed temperature difference between the first and second temperature probes.

11. The control system method of claim 10 wherein the refrigerator heat exchanger cools a water bath in an ice bank for cooling a beverage and the refrigeration compressor is turned off at periodic intervals to avoid ice build up on a beverage delivery conduit in the water bath.

12. The control system method of claim 11 wherein rate of change of the two temperature probes is monitored and when the rate of change drops to a low value it is assumed ice has formed on both probes and the compressor is turned off.

13. The control system method of claim 7 additionally comprising the steps of turning on and off the refrigerator compressor based on timed intervals following operation of the refrigerator compressor.

* * * * *